US010690018B1

(12) United States Patent
Burke

(10) Patent No.: US 10,690,018 B1
(45) Date of Patent: Jun. 23, 2020

(54) TRIGGER WHEEL FOR CAMSHAFT PHASER

(71) Applicant: Schaeffler Technologies AG & Co. KG, Herzogenaurach (DE)

(72) Inventor: Steven Burke, Fort Gratiot, MI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/291,564

(22) Filed: Mar. 4, 2019

(51) Int. Cl.
*F01L 1/34* (2006.01)
*F01L 1/344* (2006.01)
*F01L 1/047* (2006.01)

(52) U.S. Cl.
CPC ..... *F01L 1/3442* (2013.01); *F01L 1/047* (2013.01); *F01L 2001/34483* (2013.01)

(58) Field of Classification Search
CPC ..... F01L 1/3442; F01L 1/047; F01L 2001/34483
USPC ..... 123/90.17
See application file for complete search history.

(56) References Cited

U.S. PATENT DOCUMENTS 6,609,498 B2 8/2003 Mathews et al.
7,305,949 B2 12/2007 McCarthy et al.
2015/0267570 A1* 9/2015 Bayrakdar ..... F01L 1/3442 123/90.17

* cited by examiner

*Primary Examiner* — Zelalem Eshete
(74) *Attorney, Agent, or Firm* — Volpe and Koenig, P.C.

(57) ABSTRACT

A camshaft phaser assembly is disclosed. A trigger wheel is provided that includes a position indicator and a first toothing. An input gear includes a second toothing. An output gear is adapted to drive a camshaft, and defines a third toothing. The first toothing and the third toothing have an identical profile. A connection assembly includes a fourth toothing engaged with the first toothing, the second toothing, and the third toothing, such that an input provided by the input gear is transmitted to both the output gear and the trigger wheel, and the trigger wheel and the output gear are driven in unison. A method of detecting a position of a camshaft based on a trigger wheel is also disclosed.

18 Claims, 5 Drawing Sheets

TRIGGER WHEEL FOR CAMSHAFT PHASER

FIELD OF INVENTION

The present invention relates to a trigger wheel for a camshaft phaser assembly.

BACKGROUND

Camshaft phaser assemblies are well known in the automotive field. It is also known to include a trigger wheel in camshaft phaser assemblies to determine an angular position of a component within the camshaft phaser assembly, such as a phaser rotor. Known camshaft phaser assemblies including trigger wheels are disclosed in U.S. Pat. Nos. 7,305,949 and 6,609,498.

In an overhead camshaft engine, a timing sensor is typically mounted on the cam itself. In a "cam-in-block" engine design or "type-5" valve train where there is only one camshaft in a "V" engine design, the trigger wheel is typically mounted to the front of the engine at the end of the camshaft.

Mounting a trigger wheel to the end of the camshaft opposite from the gearbox is difficult since this procedure requires access deep within the engine block, which is an area that is both difficult to access and typically exposed to harsh operating conditions.

It would be desirable to provide a trigger wheel for a camshaft phaser gearbox assembly that is more easily accessible and reliably provides a camshaft position.

SUMMARY

A camshaft phaser assembly is disclosed. A trigger wheel is provided that includes a position indicator and a first toothing. An input gear includes a second toothing. An output gear is adapted to drive a camshaft, and defines a third toothing. The first toothing and the third toothing have an identical profile. A connection assembly includes a fourth toothing engaged with the first toothing, the second toothing, and the third toothing, such that a driving input provided by the input gear is transmitted to both the output gear and the trigger wheel, and the trigger wheel and the output gear are driven in unison.

In one embodiment, the connection assembly includes a wave generator and a flex ring gear, and the flex ring gear defines the fourth toothing.

In another embodiment, the flex ring gear meshes with each of the first toothing, the second toothing, and the third toothing in two meshing regions circumferentially spaced from each other.

In one embodiment, the second toothing defines a number of teeth that is within two teeth of a number of teeth defined by the first toothing and the third toothing.

In another embodiment, the trigger wheel defines at least one first fastener opening, the input gear defines at least one second fastener opening, and at least one fastener extends through the at least one first fastener opening and the at least one second fastener opening to axially retain the trigger wheel with the input gear.

In one embodiment, the at least one fastener includes a shaft having a proximal region including a circular outer surface and a distal region including a threaded outer surface. The at least one first fastener opening is defined as a circumferentially extending slot, the at least one second fastener opening is a threaded bore, and the trigger wheel is supported on the proximal region of the shaft and the distal region extends into the threaded bore of the input gear.

The assembly can further include a front cover plate defining at least one third fastener opening through which the at least one fastener extends to secure the trigger wheel, the connection assembly, and the input gear to each other.

In one embodiment, the trigger wheel axially abuts the input gear.

A method of detecting a position of a camshaft is also disclosed. The method includes providing a camshaft phaser assembly. The method includes rotationally driving an input gear such that an output gear and a trigger wheel are rotationally driven with the input gear, and the trigger wheel and the output gear are rotationally driven in unison. The method includes detecting a position of the trigger wheel via a sensor, and determining a position of a camshaft based on the position of the trigger wheel.

Additional embodiments are disclosed herein.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1:
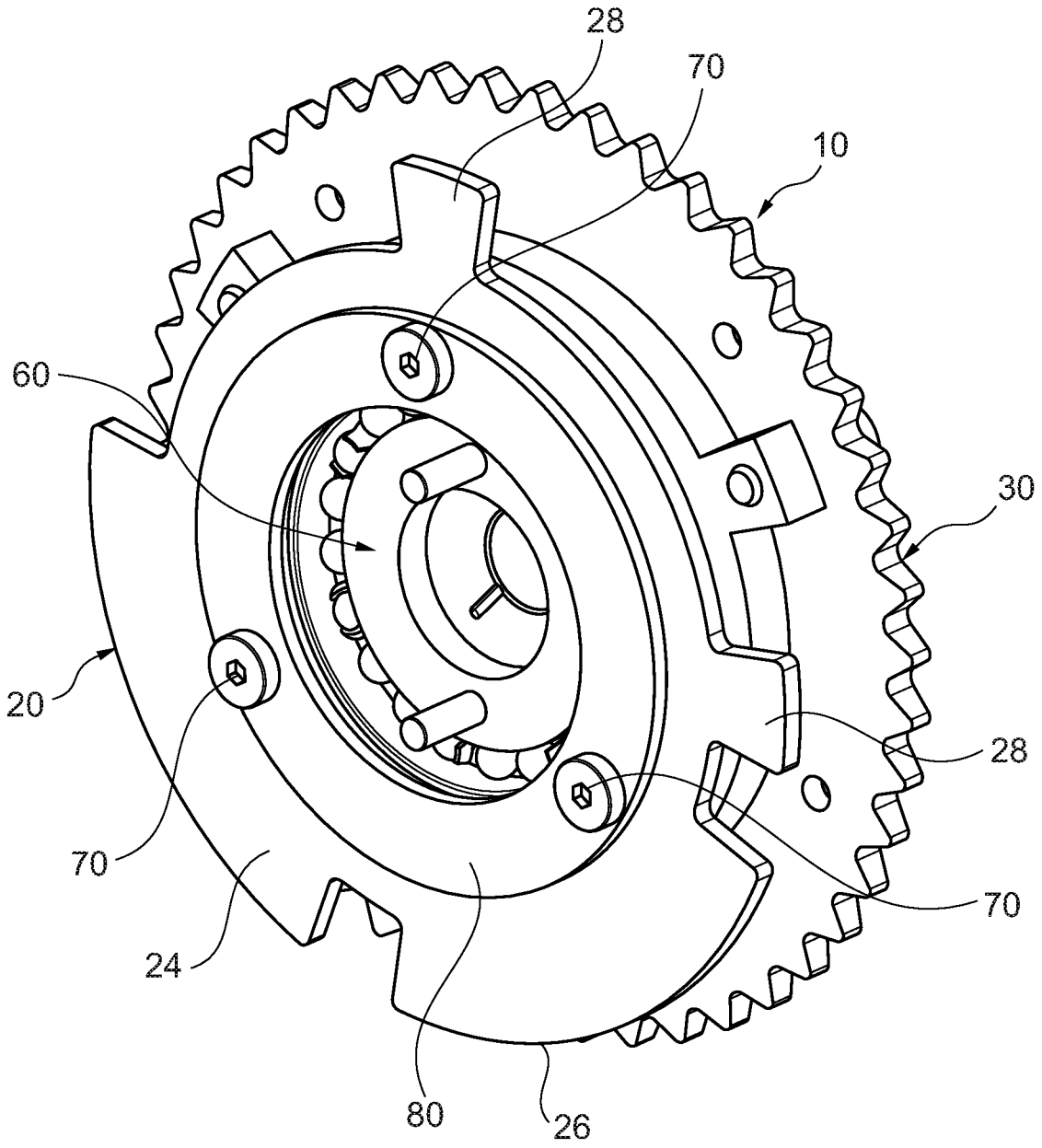
FIG. 1 is perspective view of a camshaft phaser assembly including a trigger wheel.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. "Axially" refers to a direction along the axis of a shaft. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Referring to FIGS. 1-5, a camshaft phaser assembly 10 is disclosed. The camshaft phaser assembly 10 includes a trigger wheel 20 including a position indicator 24 and a first toothing 22. A sensor 90 (shown in FIG. 3) is positioned adjacent to the trigger wheel 20 and can detect a position of the trigger wheel 20 based on the position indicator 24. Based on a position of the trigger wheel 20, a position of an associated camshaft 50 (shown in phantom lines in FIG. 3) is determined (e.g. by an associated computer, circuitry, central processing unit (CPU), sensor, etc.).

In one embodiment, the trigger wheel 20 is formed from a ferromagnetic material. The sensor 90 can be adapted to detect a position of the trigger wheel 20 based on a magnetic signal provided by the position indicator 24. Other arrangements can be provided such that the sensor 90 detects a rotational position of the trigger wheel 20. The sensor 90 can be connected to a CPU, or other known electronic components or circuitry capable of processing a position signal from the sensor 90 based on the rotational position of the trigger wheel 20. The associated CPU is configured to determine an exact position of the trigger wheel 20 based on a profile of the position indicator 24.

The position indicator 24 can include a tab, protrusion, extension, shape, edge, or other element that otherwise provides a specific profile for a portion of the trigger wheel 20. More specifically, the position indicator 24 can provide a non-uniform profile for the outer portion of the trigger wheel 20. In one embodiment, the position indicator 24 includes a radially outer edge 26 of the trigger wheel 20 that has a non-uniform profile and defines at least one radially extending tab 28.

An input gear 30 includes a second toothing 32. The input gear 30 is adapted to be driven by a crankshaft (not shown). The input gear 30 includes an external toothing adapted to be engaged with a driving chain connected to the crankshaft. The input gear 30 axially abuts the trigger wheel 20.

An output gear 40 is adapted to drive the camshaft 50. The output gear 40 defines a third toothing 42. The first toothing 22 and the third toothing 42 have an identical profile, i.e. each toothing 22, 42 has the same shape and number of teeth as each other. This configuration ensures that the trigger wheel 20 and the output gear 40 are rotationally driven in the same manner.

A connection assembly 60 provides a connection or link between the trigger wheel 20, the input gear 30, and the output gear 40. The connection assembly 60 includes a fourth toothing 62 that is engaged with the first toothing 22, the second toothing 32, and the third toothing 42, such that an input provided by the input gear 30 (i.e. via the crankshaft) is transmitted to the output gear 40 and the trigger wheel 20. The term input or driving input is used broadly herein to refer to any force or driving energy provided to the input gear 30. Based on the configuration of toothing 22 and 42, the trigger wheel 20 and the output gear 40 are rotationally driven in unison.

In one embodiment, the connection assembly 60 includes a wave generator 64 and a flex ring gear 66, and the flex ring gear 66 defines the fourth toothing 62. The wave generator 64 can include a bearing assembly including an outer ring 64*a*, an inner ring 64*b*, and rolling elements 64*c* arranged between the inner ring 64*b* and the outer ring 64*a*. The flex ring gear 66 includes a smooth radially inner surface engaged against a radially outer surface of the outer ring 64*a*. The wave generator 64 provides for selective contact or meshing between the flex ring gear 66 and the trigger wheel 20, input gear 30, and output gear 40. One of ordinary skill in the art would understand that alternative types of connection assemblies 60 can be used.

The outer ring 64*a* has a first axial width, the flex ring gear 66 has a second axial width, and the first axial width is equal to or greater than the second axial width. This arrangement ensures reliable contact between the radially outer surface of the outer ring 64*a* and the radially inner surface of the flex ring gear 66.

Figure 2:
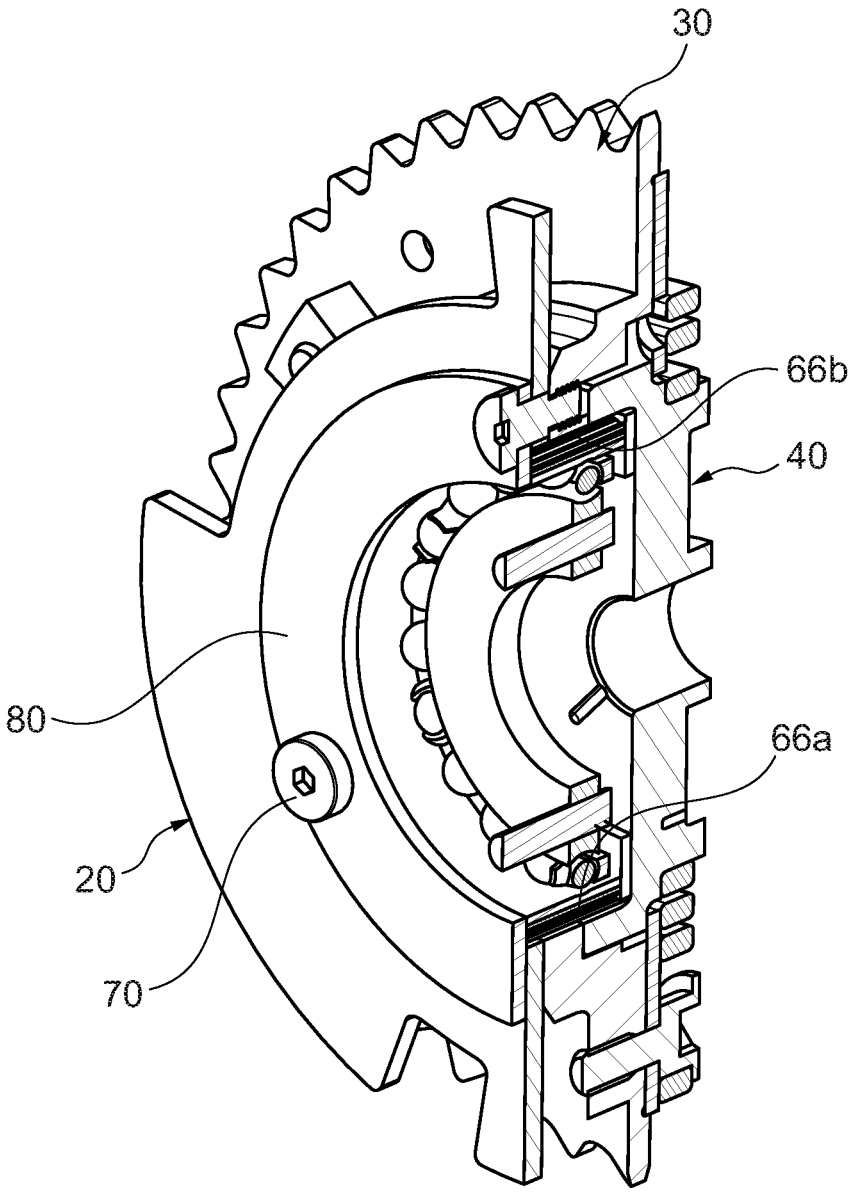
FIG. 2 is a cross-sectional perspective view of the camshaft phaser assembly of FIG. 1.
Figure 3:
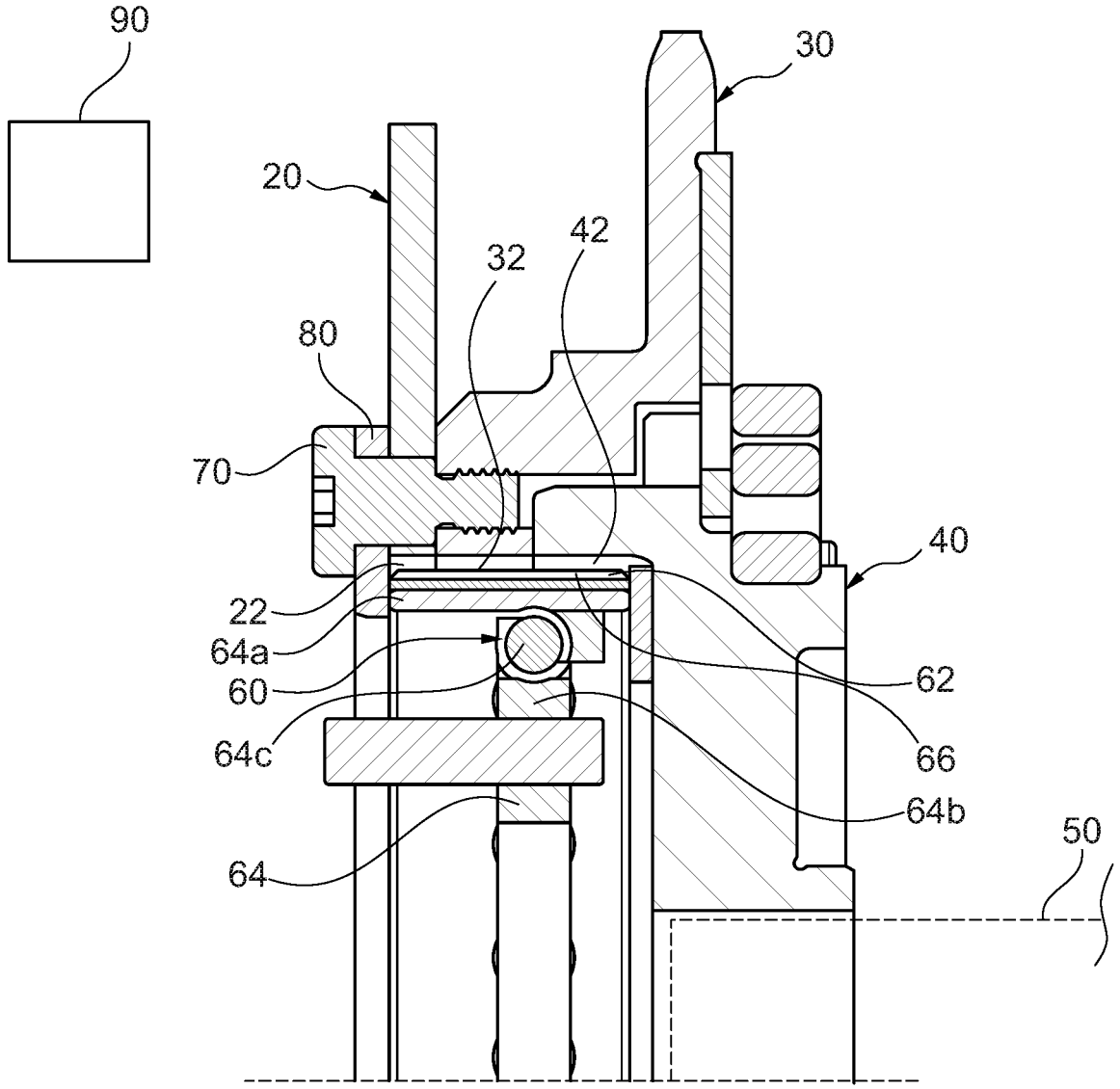
FIG. 3 is a cross-sectional side view of the camshaft phaser assembly of FIGS. 1 and 2.

In one embodiment, the flex ring gear 66 meshes with each of the first toothing 22, the second toothing 32, and the third toothing 42 in two meshing regions 66*a*, 66*b* circumferentially spaced from each other. In one embodiment, as shown in FIG. 2, the two meshing regions 66*a*, 66*b* are separated by 180 degrees.

In one embodiment, the second toothing 32 defines a number of teeth that is within two teeth of a number of teeth defined by the first toothing 22 and the third toothing 42. Based on an arrangement of toothing 22 on the trigger wheel 20 and toothing 42 on the output gear 40 (which is fixed to the camshaft 50), a position of the trigger wheel 20 corresponds to a position of the camshaft 50. The camshaft 50 can be connected to the output gear 40 according to a variety of ways known to those of ordinary skill in the art, for example a bolted connection.

The trigger wheel 20 is axially secured with the input gear 30. In one embodiment, the trigger wheel 20 defines at least one first fastener opening 25, and the input gear 30 defines at least one second fastener opening 35. At least one fastener 70 extends through the at least one first fastener opening 25 and the at least one second fastener opening 35 to axially retain the trigger wheel 20 with the input gear 30. The at least one fastener 70 can include multiple fasteners and there can be a corresponding number of fastener openings 25, 35.

In one embodiment, each of the fasteners 70 includes a shaft 72 having a proximal region 74 including a circular outer surface and a distal region 76 including a threaded outer surface. In one embodiment, the first fastener opening 25 is defined as a circumferentially extending slot, and the at least one second fastener opening 35 is a threaded bore. The circumferentially extending slot of the trigger wheel 20 is supported on the proximal region 74 of the shaft 72 and the distal region 76 of the shaft 72 extends into the threaded bore of the input gear 30. In another embodiment, the fasteners 70 have a standard socket head cap profile.

Figure 4:
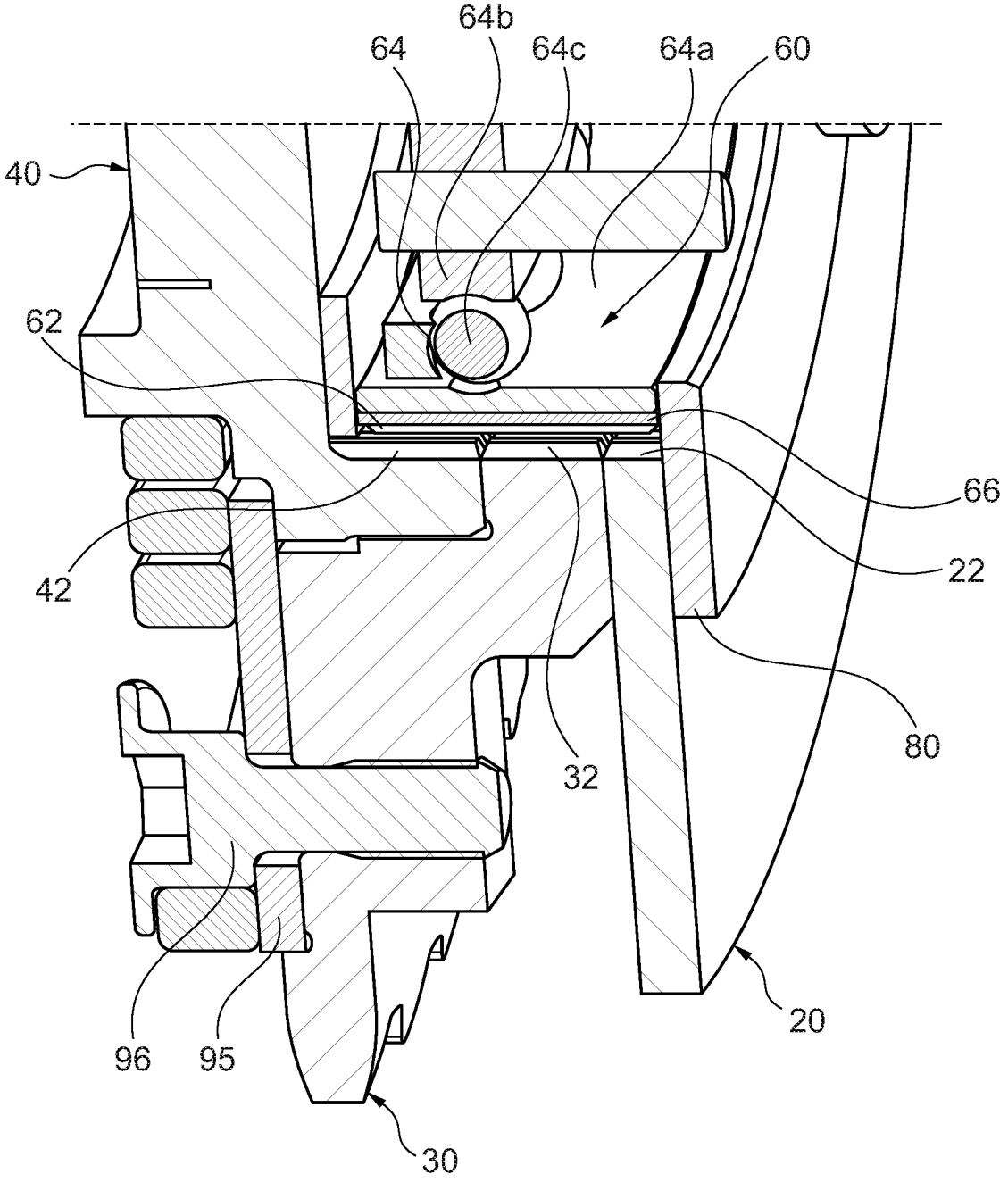
FIG. 4 is a magnified cross-sectional view of the camshaft phaser assembly of FIGS. 1-3.
Figure 5:
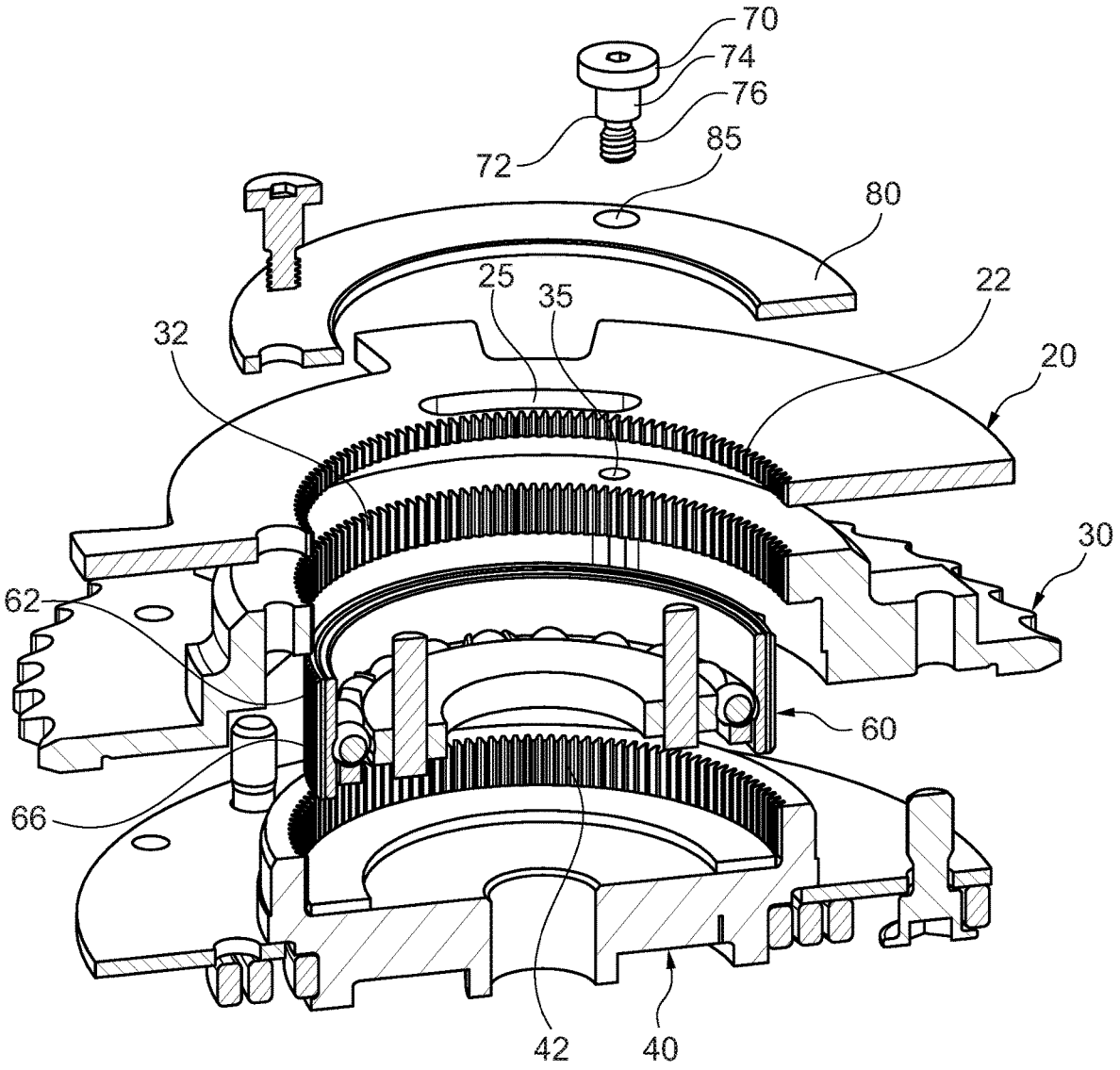
FIG. 5 is an exploded cross-sectional view of the camshaft phaser assembly of FIGS. 1-4.

In one embodiment, the assembly 10 also includes a front cover plate 80 defining at least one third fastener opening 85 through which the at least one fastener 70 extends to axially secure the trigger wheel 20, the connection assembly 60, and the input gear 30. Other fastening arrangements can be provided to ensure the trigger wheel 20, the input gear 30, the outer gear 40, and the connection assembly 60 are axially retained with each other. As shown in FIG. 4, a rear cover 95 can be provided that is fastened with the input gear 30 via at least one secondary fastener 96. One of ordinary skill in the art would understand that the covers are optional.

A method of detecting a position of a camshaft 50 is also provided. The method includes providing the camshaft phaser assembly 10 described herein. The method includes rotationally driving the input gear 30 such that the output gear 40 and the trigger wheel 20 are rotationally driven and the trigger wheel 20 and the output gear 40 are rotationally driven in unison. The method includes detecting a position of the trigger wheel 20 via a sensor 90, and determining a position of the camshaft 50 based on the position of the trigger wheel 20.

Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein.

The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

LOG OF REFERENCE NUMERALS camshaft phaser assembly 10
trigger wheel 20
first toothing 22
position indicator 24
first fastener opening 25
radially outer edge 26
radially extending tab 28
input gear 30
second toothing 32
second fastener opening 35
output gear 40
third toothing 42
camshaft 50
connection assembly 60
fourth toothing 62
wave generator 64
outer ring 64*a*
inner ring 64*b*
rolling elements 64*c*
flex ring gear 66
meshing regions 66*a*, 66*b*
fastener 70
shaft 72
proximal region 74
distal region 76
front cover plate 80
third fastener opening 85
sensor 90
rear cover 95
secondary fastener 96

What is claimed is:

1. A camshaft phaser assembly comprising:

a trigger wheel including a position indicator and a first toothing;

an input gear adapted to be driven, the input gear including a second toothing;

an output gear adapted to drive a camshaft, the output gear defining a third toothing, the first toothing and the third toothing having an identical profile; and a connection assembly including a fourth toothing engaged with the first toothing, the second toothing, and the third toothing, such that an input provided by the input gear is transmitted to both the output gear and the trigger wheel, and the trigger wheel and the output gear are driven in unison.

2. The camshaft phaser assembly of claim 1, wherein the connection assembly includes a wave generator and a flex ring gear, and the flex ring gear defines the fourth toothing.

3. The camshaft phaser assembly of claim 2, wherein the wave generator includes a bearing assembly including an outer ring, an inner ring, and rolling elements arranged between the inner ring and the outer ring.

4. The camshaft phaser assembly of claim 3, wherein the outer ring has a first axial width, the flex ring gear has a second axial width, and the first axial width is equal to or greater than the second axial width.

5. The camshaft phaser assembly of claim 2, wherein the flex ring gear meshingly engages with each of the first toothing, the second toothing, and the third toothing in two meshing regions circumferentially spaced from each other.

6. The camshaft phaser assembly of claim 5, wherein the two meshing regions are separated by 180 degrees.

7. The camshaft phaser assembly of claim 1, wherein the second toothing defines a number of teeth that is within two teeth of a number of teeth defined by the first toothing and the third toothing.

8. The camshaft phaser assembly of claim 1, wherein the position indicator includes a radially outer edge that has a non-uniform profile and defines at least one radially extending tab.

9. The camshaft phaser assembly of claim 1, wherein the trigger wheel defines at least one first fastener opening, and the input gear defines at least one second fastener opening, and at least one fastener extends through the at least one first fastener opening and the at least one second fastener opening to axially retain the trigger wheel with the input gear.

10. The camshaft phaser assembly of claim 9, wherein the at least one fastener includes a shaft having a proximal region including a circular outer surface and a distal region including a threaded outer surface, the at least one first fastener opening is defined as a circumferentially extending slot, and the at least one second fastener opening is a threaded bore, and the trigger wheel being supported on the proximal region of the shaft and the distal region extending into the threaded bore of the input gear.

11. The camshaft phaser assembly of claim 10, further comprising a front cover plate defining at least one third fastener opening through which the at least one fastener extends to secure the trigger wheel, the connection assembly, and the input gear.

12. The camshaft phaser assembly of claim 1, wherein the trigger wheel axially abuts the input gear.

13. A method of detecting a position of a camshaft, the method comprising;

providing:

a camshaft phaser assembly including:

a trigger wheel including a position indicator and a first toothing;

an input gear adapted to be driven, the input gear including a second toothing;

an output gear adapted to drive a camshaft, the output gear defining a third toothing, the first toothing and the third toothing having an identical profile; and a connection assembly including a fourth toothing engaged with the first toothing, the second toothing, and the third toothing;

rotationally driving the input gear such that the output gear and the trigger wheel are rotationally driven and the trigger wheel and the output gear are rotationally driven in unison;

detecting a position of the trigger wheel via a sensor; and determining a position of the camshaft based on the position of the trigger wheel.

14. The method of claim 13, wherein the connection assembly includes a wave generator and a flex ring gear, and the flex ring gear defines the fourth toothing.

15. The method of claim 14, wherein the wave generator includes a bearing assembly including an outer ring, an inner ring, and rolling elements arranged between the inner ring and the outer ring.

16. The method of claim 13, wherein the trigger wheel axially abuts the input gear.

17. The method of claim 13, wherein the second toothing defines a number of teeth that is within two teeth of a number of teeth defined by the first toothing and the third toothing.

18. The method of claim 13, wherein the position indicator includes a radially outer edge that has a non-uniform profile and defines at least one radially extending tab.

* * * * *